US005273415A

United States Patent [19]

Jackson

[11] Patent Number: 5,273,415

[45] Date of Patent: Dec. 28, 1993

[54] FLYING FORM APPARATUS FOR USE IN CONSTRUCTION

[76] Inventor: George W. Jackson, 301-2240 Bellevue Avenue, West Vancouver, British Columbia, Canada, V7V 1C6

[21] Appl. No.: 653,549

[22] Filed: Feb. 11, 1991

[51] Int. Cl.[5] ..... E04G 11/48; E04G 11/22

[52] U.S. Cl. ..... 425/62; 425/454; 248/163.1; 248/188.2; 249/24; 249/26; 249/211; 264/33

[58] Field of Search ..... 425/62, 453, 454; 249/24, 118, 28, 26, 29, 23, 30, 210, 211, 219.1; 248/163.1, 188.2; 264/33

[56] References Cited

U.S. PATENT DOCUMENTS

| | | | |
|---|---|---|---|
| 3,306,562 | 2/1967 | Bellefleur | 248/188.2 |
| 3,827,840 | 8/1974 | Kistler | 425/62 |
| 3,966,164 | 6/1976 | Dashew | 425/62 |
| 3,977,536 | 8/1976 | Moore et al. | 425/62 |
| 4,036,466 | 7/1977 | Van Meter | 249/18 |
| 4,244,682 | 1/1981 | Willingham | 425/62 |
| 4,470,574 | 9/1984 | Jackson | 249/29 |
| 4,585,204 | 4/1986 | Parker et al. | 425/62 |
| 4,666,388 | 5/1987 | Kovasna et al. | 425/62 |
| 4,790,113 | 12/1988 | Gregory | 249/28 |
| 4,926,593 | 5/1990 | Johnston | 249/28 |

FOREIGN PATENT DOCUMENTS

| | | | |
|---|---|---|---|
| 650749 | 10/1962 | Canada . | |
| 700184 | 12/1964 | Canada . | |
| 941138 | 2/1974 | Canada . | |
| 2454701 | 5/1976 | Fed. Rep. of Germany | 425/62 |
| 258555 | 12/1967 | Netherlands | 425/62 |

*Primary Examiner*—Khanh P. Nguyen
*Attorney, Agent, or Firm*—Jeffrey T. Imai; Arne I. Fors; D. Doak Horne

[57] ABSTRACT

A concrete forming apparatus for use in construction of buildings having poured concrete floors spanning between two adjacent supports at a desired height is disclosed. The apparatus includes a frame having extensible strut members extending capable of temporarily fixing the height of the frame, supports for supporting and maneuvering the frame and rollers for rolling the frame along as the frame is flown from under the concrete floor up onto the concrete floor. The supports include a first trucking device adapted to engage the frame for raising the frame from a rest position whereby the frame is spaced above a floor surface to a pouring position whereby the upper deck is substantially at the desired height and for rolling the frame to a desired location. The supports further include a support device for supporting the frame while in the pouring position during the pouring and curing of the concrete floor having means for finely adjusting the height of the frame prior to the pouring of the concrete. The supports further include a second trucking device for lifting the frame from the rest position after the form has been removed from the cured concrete and placing the frame onto the rollers means.

11 Claims, 11 Drawing Sheets

FLYING FORM APPARATUS FOR USE IN CONSTRUCTION

FIELD OF THE INVENTION

This invention relates to an apparatus for and method of construction using flying forms for use in the construction of buildings having poured concrete floors. In particular this invention relates to an improved apparatus for successively installing a lower platform or table for forming a concrete floor during the construction of a multifloored building.

BACKGROUND OF THE INVENTION

It is common practice in the construction industry to use flying forms or gang forms in the construction of multifloored buildings such as condominiums and the like. The floor of such buildings extend from supporting walls or columns arranged as a series of bays. A plurality of like forms can be arranged on a ground floor in the bays to provide a first upper form surface. The surface extends from the top of a first wall or column to the top of the next adjacent wall or column. Concrete is poured over the surface and once cured forms a second floor. Walls or columns for the second floor are then constructed while the first floor cures or partially cures. The forms are then removed from under the second floor. The form is then rolled out of the building until approximately $\frac{1}{3}$ of the length of the form extends beyond the edge of the floor. A crane is then connected to the form with two front lines, then the form is rolled out until approximately $\frac{2}{3}$ of the length of the form extends beyond the edge of the floor. A second set of lines are attached to the form which is then hoisted up and placed on the second floor to act as a platform for pouring the concrete which will form the third floor. The process is repeated until the desired number of floors have been constructed.

The use of such forms have been described in Canadian Patent 941,138. FIG. 1 illustrates the flying forms of Canadian Patent 941,138 which are commercially available under the Trade-mark ALUMA.

Canadian Patent 941,138 discloses a flying form as a concrete forming structure wherein the deck on which the concrete is poured is easily and readily secured to the upper edges of a plurality of beams which are set transversely across a pair of uniform truss members, having a top chord and a lower chord. The truss members are provided with a plurality of screw jacks hingedly secured to the lower chord to present a telescopic leg member. When the structure is to be pulled out and flown, auxiliary jacks such as car jacks are placed under the lower chord, the screw jacks are then swung from beneath the lower chord and secured in an upright position keeping the bottom of the lower chord free of obstruction. Once the screw jacks are in an upright position, the truss is lowered, sometimes 2 feet, to rest on beam rollers to permit the structure to be rolled out of the bay or building.

Flying forms as disclosed in Canadian Patent 941,138 have improved the efficiency of the construction of poured in place concrete buildings. However, such forms require extensive manual labour in manipulating the screw jacks and the leg members and in maneuvering the forms once resting on the floor prior to positioning and in lowering the forms onto rollers so they can be flown from floor to floor.

The prior art form has a height substantially less than the desired height between lower floor and upper floor to be poured to allow the form to pass through openings of a height less than the floor to floor height, for example where a spandrel beam is used. Therefore the form is made in a reduced height to accommodate the reduced opening and therefore must be raised a considerable height before the upper surface of the form is at the desired level.

Elaborate hydraulic jacks have been developed in order for the form to be raised to and lowered from the desired height. However, these hydraulic jacks must be relatively large in order to raise or lower the form and are therefore cumbersome to operate and expensive to manufacture.

Standard hydraulic automobile jacks have been also used to raise or lower the form by placing the standard jacks under the lower chord of the form. This method has proved to be slow with limited success as a uniform height of the upper level of the form is difficult to achieve for the required degree of accuracy. Further, the labour time required to set the forms to the desired height has been high and therefore costly.

The most common procedure is to have the crane hold the form a few feet above the newly poured floor while workers lower the adjusting legs so the form can be set down in approximately the desired position. This procedure requires considerable crane time which is expensive and inefficient.

Once the form has been set to the desired height it is very difficult to move the form if it has not been properly placed. The result is that adjacent forms may not be immediately adjacent to each other or adjacent to the wall leaving irregularly shaped openings in the upper deck of the form. This effect is highly undesirable. Plywood sheets must then be cut for each floor in order to cover these openings prior to pouring the concrete, adding costs to the construction of the building both in terms of material costs and labour costs.

Landing dollies have been also developed for the prior art forms. These dollies are required to be of a substantial height to reduce the distance which the form must be raised to achieve the desired height of the upper deck. Accordingly, the dollies are large and cumbersome. Further, a good number of these dollies are required if the crane waiting time is to be substantially reduced. However, the flying forms still require significant labour to lower the legs, set the jacks and remove the dollies.

SUMMARY OF THE INVENTION

The disadvantages of the prior art may be overcome by providing a flying form which is adapted to be moved about a floor such that two or more flying forms may be placed or maneuvered parallel to each other with a minimum of manual labour.

It is still a further object of the this invention to provide a flying form which may be maneuvered to present uniform spaces between two or more flying forms or between a flying form and a wall or row of columns so that filler strips of plywood may be prepared and reused for subsequent floors.

It is another object of this invention to provide a flying form which has extensible struts to provide a form which is adjustable to be substantially the same height as the concrete floor to be poured.

It is still a further object of this invention to provide a form which is suitable for construction of poured concrete floors where the openings between the floors have the same height as the height between floors.

It is still a further object of this invention to provide a device for maneuvering the flying forms both prior to setting the form and for flying the form.

It is still a further object to provide device for supporting the form while supporting the concrete while it partially cures.

According to one aspect of the invention there is provided a concrete forming apparatus for use in construction of buildings having poured concrete floors spanning between two adjacent walls or columns at a desired height, comprising a) a frame having a first and second truss having longitudinally extending upper and lower chords and extensible strut members extending therebetween capable of temporarily fixing the distance between the upper and lower chords, said upper and lower chords having a plurality of bores for securing said strut members, the lower chord adapted to receive a support means, spacing means for releasably connecting the first and second trusses in a spaced substantially parallel relation, transverse joist members releasably connected to the upper chords of the truss, a substantially planar upper deck releasably joined to the joist members providing a lower form surface of a concrete floor to be poured, whereby the height of the frame is of the same order but less than the desired height, and b) support means for supporting and maneuvering the frame, comprising a first trucking device for raising the frame from a rest position whereby the frame is spaced above a floor surface to a pouring position whereby the upper deck is substantially at the desired height, and for rolling the frame to a desired location;

a support apparatus for supporting the frame while in the pouring position during the pouring and partial curing of the concrete floor and having means for finely raising or lowering the frame;

a second trucking device for lifting the frame from the rest position after the form has been lowered from the cured concrete and for rolling the frame onto a roller means;

said roller means adapted to receive the lower chords of the frame for rolling the frame along as the frame is flown from under the concrete floor out and up onto the concrete floor.

According to another aspect of the invention there is provided a device comprising a frame having rollers mounted thereon for rolling along a floor, a platform slidingly engaging the frame and adapted for vertical movement relative to the frame and a jack connected between the frame and the platform for effecting said movement, said platform having second rollers mounted thereon substantially perpendicular to the first rollers and adapted for receiving the flying form and assisting in maneuvering the frame to the desired location.

DESCRIPTION OF THE DRAWINGS

In the drawings which illustrate embodiments of the invention.

THE PRIOR ART

Figure 1A:
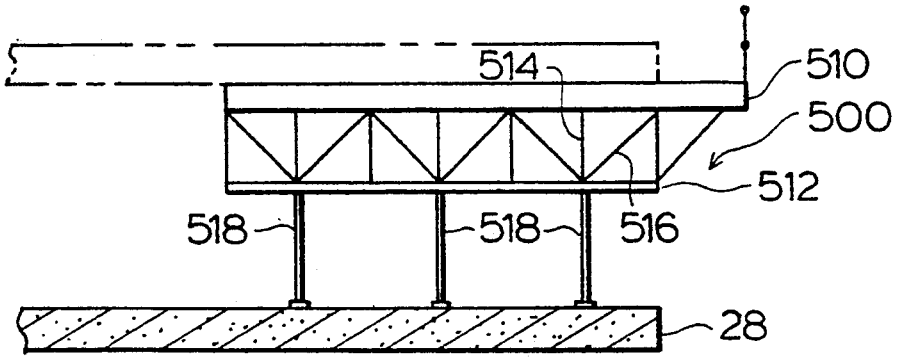
FIG. 1A (PRIOR ART)
FIG. 1*a* is a side elevational view of the prior art in a position for supporting concrete.
Figure 1B:
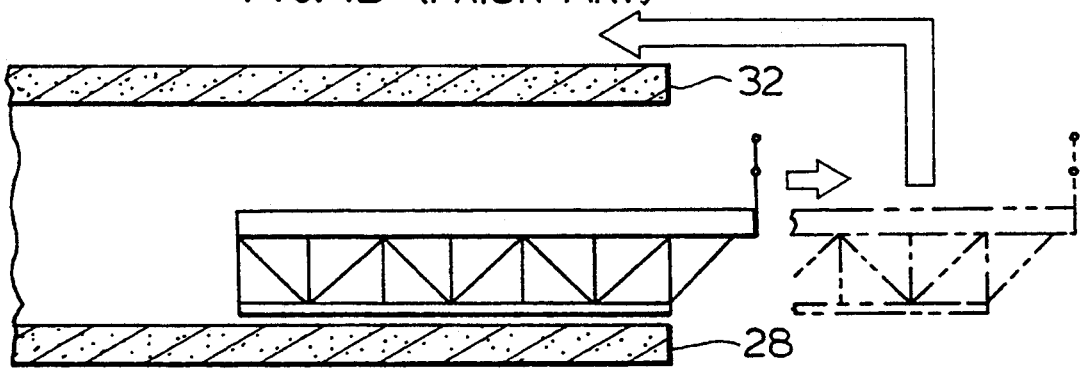
FIG. 1B (PRIOR ART)
FIG. 1*b* is a side elevational view of the prior art in a flying position.

The flying form of the prior art is illustrated in FIGS. 1*a* and 1*b* and is generally shown at 500. Flying form 500 is provided with an upper chord 510 and a lower chord 512. Extending between the upper and lower chords are vertical struts 514 and diagonal struts 516. Flying form 500 is provided with legs 518 which have screw jacks at the ends thereof for raising and lowering the form to the desired height.

In order to fly the form 500 from one floor 28 to the next upper floor 32, four large jacks or large blocks must be placed under lower chord 512 thereby taking the weight of the form permitting the screw jacks to be loosened and the holding pins to be removed from the legs 518 so the legs can be retracted into the lower chord and the screw jacks folded out of the way. The form can be then lowered onto rollers on floor 28 so it can traverse and be flown up to the next floor by being attached to a crane and hoisted.

The Preferred Embodiment

Figure 2:
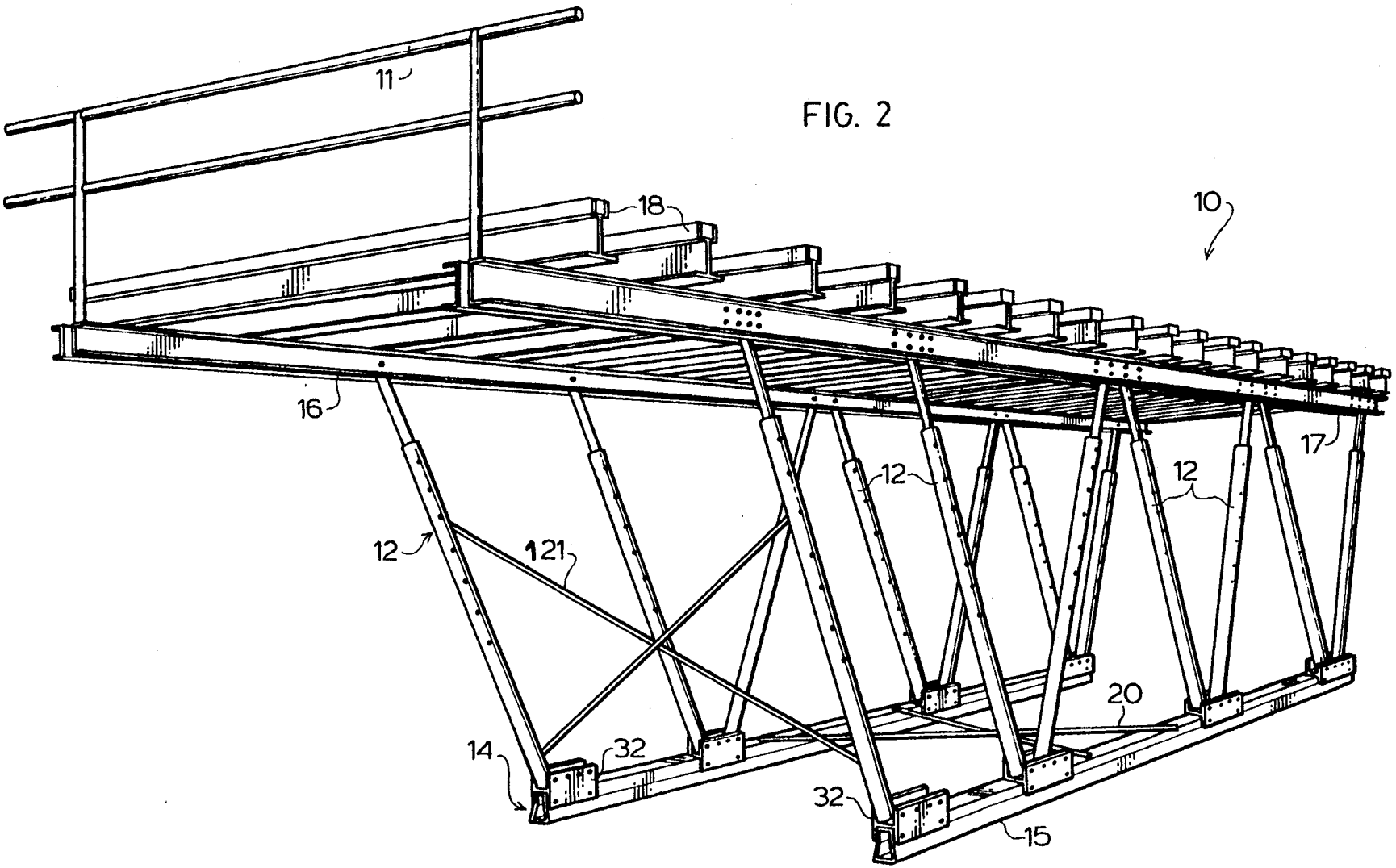
FIG. 2 is a perspective view of a flying frame of the present invention.

The flying form of the preferred embodiment is shown generally at 10 in FIG. 2 and includes a series of diagonally aligned extensible struts 12 suspended between a lower chord 14 and an upper chord 16 which are in substantially parallel arrangement. The upper and lower chords are spaced apart and aligned with lower chord 15 and upper chord 17 of adjacent truss members to provide support for a series of support beams 18 that are spanned between them in substantially perpendicular arrangement. One end of chords 16 and 17 is provided with a guard railing 11.

Adjacent struts 12 are positioned in a series of upright "V" arrangements to give the necessary support for the weight to be placed on the upper chord when the concrete is placed upon the frame in a manner to be described below. It might be noted that adequate weight support is maintained by this arrangement and an additional upright vertical support (vertical strut 514 of FIG. 1*a*) between lower and upper chords such as described in Canadian Patent 941,138 is not required. Pairs of cross braces 20 can also be secured across adjacent lower chords 14 to insure lateral rigidity. Although only one pair of cross braces have been illustrated, more than one pair may be required for lateral rigidity.

Figure 3:
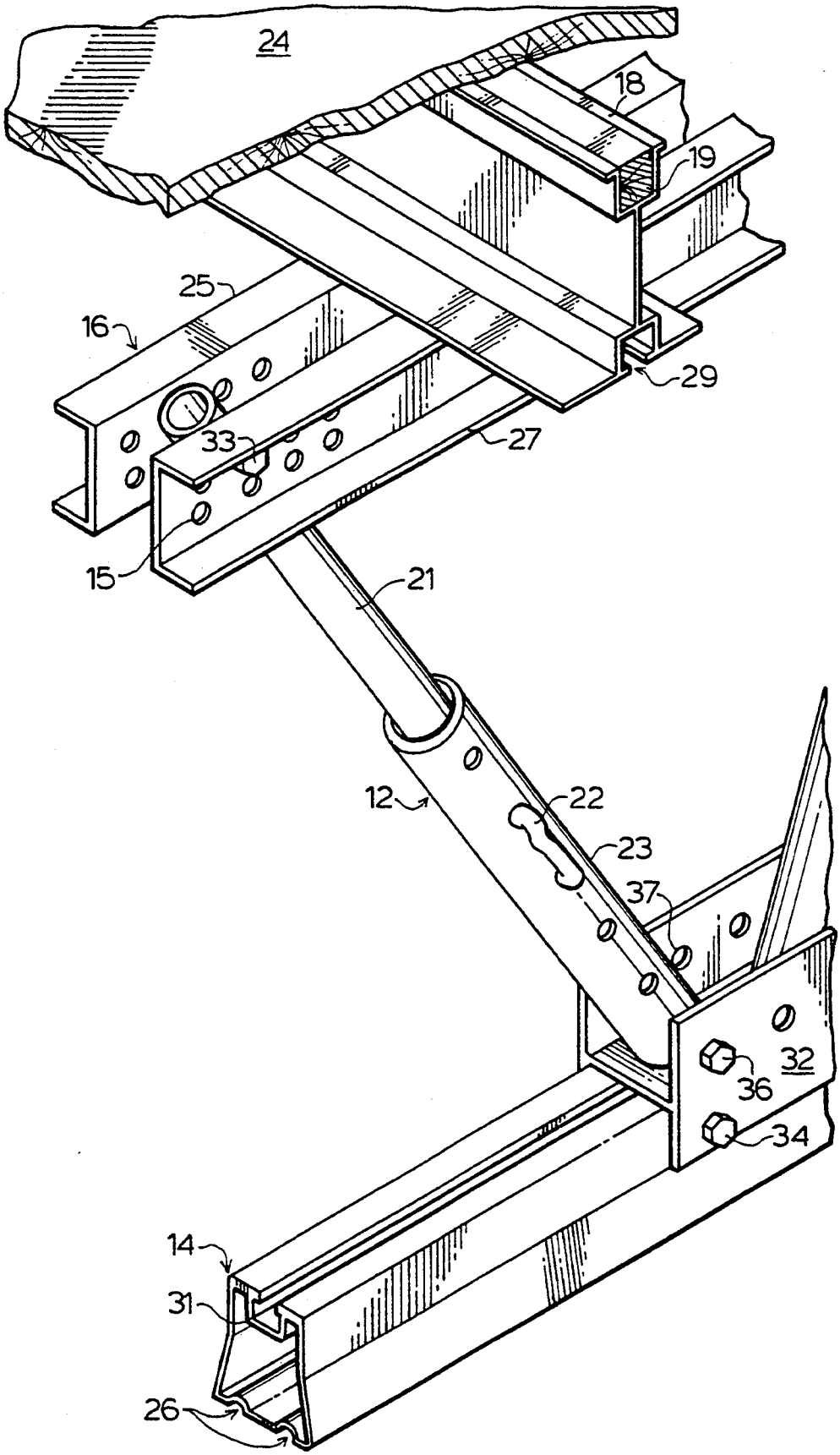
FIG. 3 is a perspective view of a partial broken-away section of the above flying frame of the embodiment of FIG. 2.

FIGS. 3 illustrates a broken-away section of the flying frame, showing the elements in greater detail. Strut 12 is telescopically adjustable by aligning holes in the inner member 21 and outer member 23 of the strut and then securing the aligned holes by means of a locking pin 22. This alignment can more easily be made by using a locking pin of substantially "U" shape for both supporting and holding the inner member on both legs of the pin in required alignment. The longer portion of the "U" pin 22 is inserted into the desired hole along the length of outer member 23. The inner member 21 is inserted into outer member 23 until it contacts the "U" pin 22. Upon contact with the "U" pin 22, the first hole of the inner member 21 becomes aligned with the corresponding hole of the outer member 23 permitting the shorter portion of the "U" pin 2 to be inserted to secure the extensible strut 12 together. A cotter pin can be used to retain the "U" pin 22 in the strut 12. One such "U" pin arrangement is particularly described in U.S. Pat. No. 4,470,574.

Upper chord 16 comprises a pair of brace rails having a channel configuration in cross section and secured back to back with the leading end of inner member 21 of strut 12 bolted therebetween by bolt and nut 33. Upper chord 16 is provided with a plurality of through bores 15 through any of which nut and bolt 33 can extend. Support beams 18 has an "I" beam configuration in cross section. The cross sectional shape of the support beam 18 is described in Canadian Patent 941,138. Support beam 18 is bridged across upper chord 16 and extends beyond it to a desired length. Support beam 18 has a channel 29 in the lower surface thereof. Channel 29 receives a "T" bolt (not illustrated) which can be used to secure support beam 18 to upper chord 16 in a manner well known in the art, thereby rigidly affixing the support beams 18 to the upper chord 16 and 17.

Upper deck 24 is supported across the series of support beams 18. Deck 24 is usually made of plywood and can be secured to the support rail by being nailed or screwed into wooden members 19 held within the hat section of beam 18 in a manner well known in the art. Such supports are described in Canadian Patent 941,138.

Lower chords 14 and 15 are hollow extruded members having a pair of gripping recesses 26 extending along the length of lower chord 14 or 15. As will be described below, the gripping recess 26 is used to assist in the gripping, raising and moving of the flying frame. The upper surface of the lower chord 14 and 15 has a "T" bolt channel 31 centrally located and extending along the entire length of the lower chord 14 and 15.

Lower chords 14 and 15 are provided with an attachment plate 32 having an "H" configuration in cross-section. The width of the plate 32 is substantially the same as the width of lower chord 14 such that the plate 32 will straddle the lower chord 14 when installed. Plate 32 can be attached to the lower chord 14 by means of a nut and bolt 34 extending through a hole drilled through chord 14 or 15. Plate 32 has a plurality of through bores 37. Plate 32 may also be used to splice two chord members together. The lower end of outer member 23 of strut 12 may be connected to plate 32 by means of a bolt and nut 36.

It can be seen that due to the adjustability of strut length and angle alignment of the both ends of the strut, considerable variation can be made in setting the distance between the lower and upper chords and the angle of struts 12 in the frame.

Adjacent lower chords 14 and 15 are connected together by cross-braces 20. Lower chords 14 and 15 have "T" bolt channels 31 along the length thereof. A "T" head bolt is used to secure the cross-braces to the lower chords. The outer members 23 of the strut 12 are provided with a pair of locking pins for receiving cross-braces 121 for securing the struts 12 together. One such locking pin is described in detail in Canadian Patent no. 650,749 and 700,184.

Although each strut 12 is provided with at least a pair of locking pins, not every pair requires a cross-brace 121 in order to achieve sufficient rigidity of the frame 10. It will be evident to a person skilled in the art as to the requisite number of cross-braces 20 and 121 needed to make the frame 10 sufficiently rigid to carry the required load. Further, load charts can be made to ensure the requisite number of cross-braces are used.

Figure 4A:
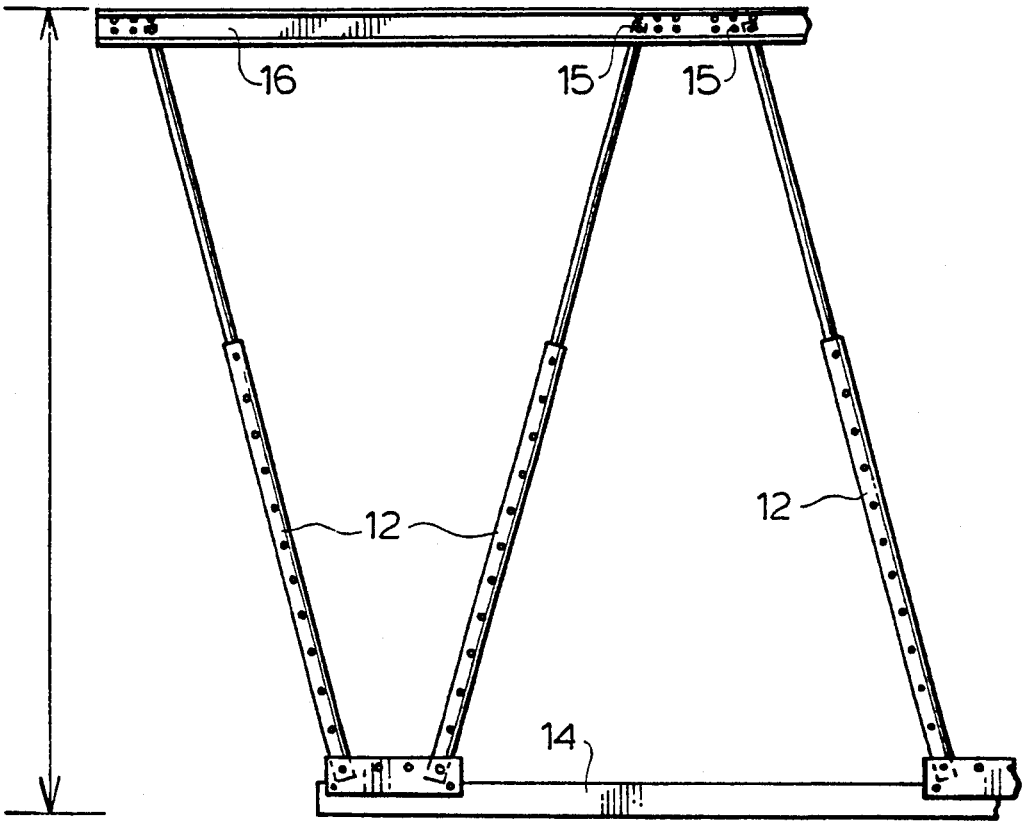
FIG. 4*a* is a partial side view of the above flying frame of the embodiment of FIG. 2 in an extended height position.
Figure 4B:
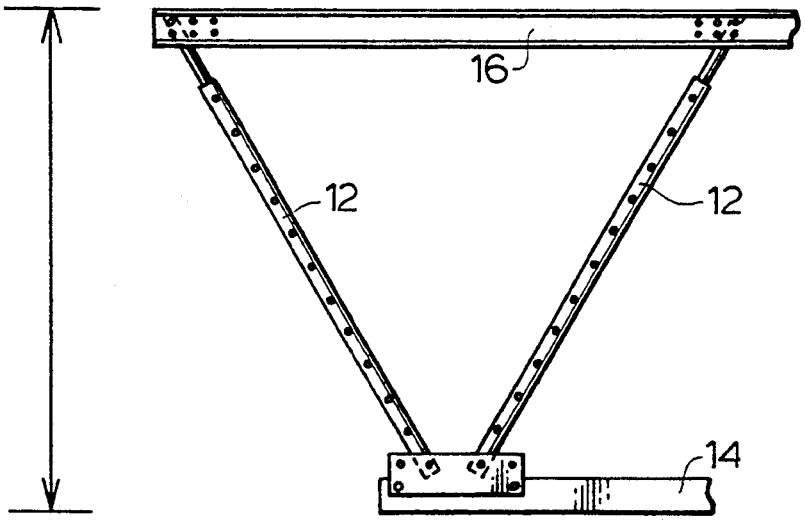
FIG. 4*b* is a partial side view of the above flying frame of the embodiment of FIG. 2 in a reduced height position.
Figure 5A:
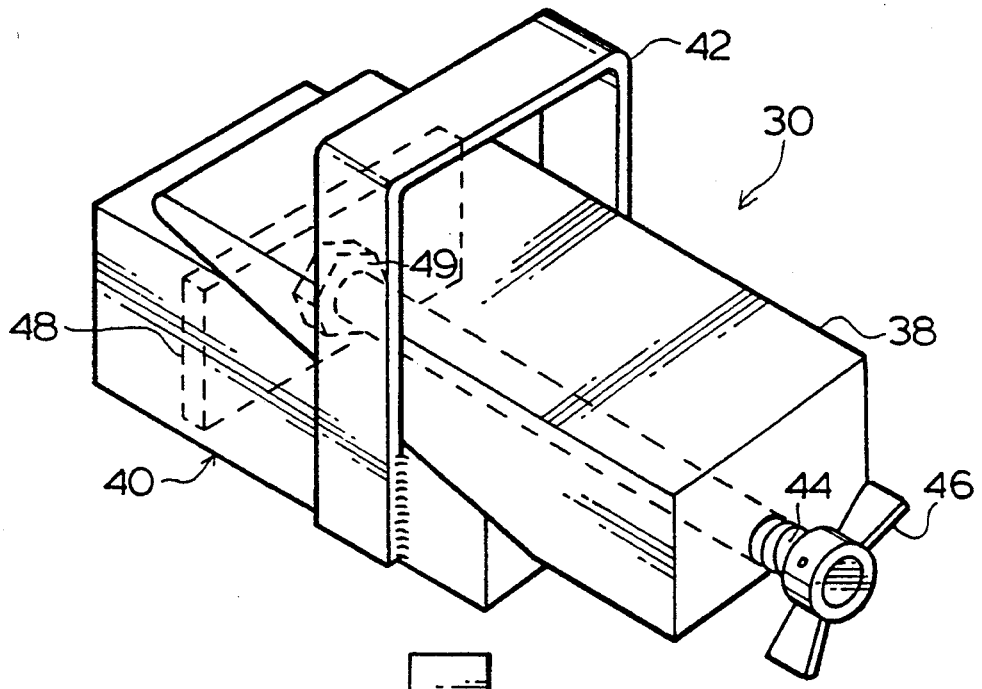
FIG. 5*a* is a perspective view of the adjustable wedge blocks used in the present invention.
Figure 5B:
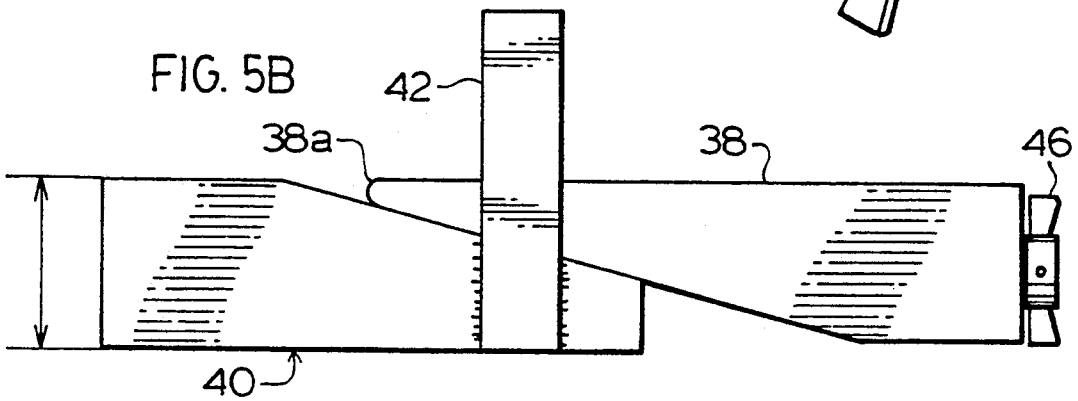
FIG. 5*b* is a partial side view illustrating one position of the pair of wedged blocks of FIG. 5*a;*
Figure 5C:
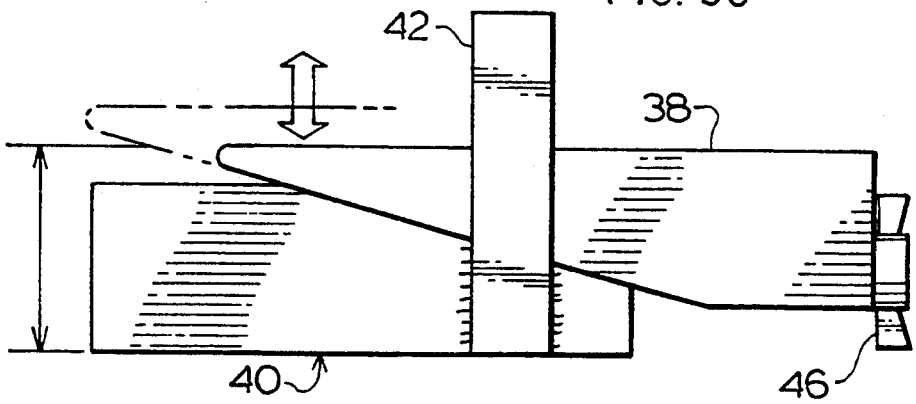
FIG. 5*c* is a partial side view illustrating another position of the pair of wedged blocks of FIG. 5*a;*

In FIGS. 4*a* and 4*b* the form is illustrated in an extended fashion and a reduced fashion, respectively. The desired height of the upper deck can be calculated and preset such that a person setting up the form simply needs to know the height between the floors to be constructed and can refer to a chart for the proper combination of hole settings in the strut, upper chord and H plate 32 settings.

The length of lower chord 14 or 15 is usually less that the length of upper chord 16. In the preferred embodiment, lower chord 14 and 15 will have an additional half pair of struts arranged in a "V" fashion as illustrated in FIG. 2. The end with the extra half "V" is the end of the form which does not support the concrete while it cures but rather extends out past the edge of the floor and is used primarily for a walkway for workers during the pouring process. Guard railing 11 is provided for safety reasons.

Wedged blocks 30 are shown in detail in FIGS. *5a*, *5b* and *5c*. These wedge blocks are used to finely raise or lower the level of the flying frame deck prior to the concrete pouring operation described below. Wedge blocks 30 consists of a mating pair of slidable wedges in which upper wedge 38 may be drawn along lower wedge 40 so that its upper surface overrides the lower block and thereby increases or decreases the height of block 30 itself. The wedges are drawn along a pair of mating tracks in a manner well known in the art and are aligned together by securing bracket 42. Bracket 42 also serves as a handle for carrying the wedge blocks 30.

Upper and lower wedges are drawn forward and away from each other by the action of threaded shaft 44 which is threaded through a nut 49 attached or welded over an opening 48 in lower wedge 40 and illustrated in broken outline in FIG. *9a*. The threading operation can be conducted manually by turning adjustment handle 46 which is affixed to threaded shaft 44.

In FIG. *5b*, the wedges are drawn apart to their maximum distance so that the height of the block is approximately equal to the height of the lower wedge 40.

In FIG. *5c*, the upper wedge 38 is shown partially drawn up onto lower wedge 40. In this position, handle 46 is threaded further into nut 49 pushing the upper wedge forward with respect to lower wedge 40. The broken outline of the leading edge of upper wedge 38 further illustrates that mating of the wedges can continue if even greater height is required. The arrows indicate the change in height adjustment that is made with such mating of the cooperating wedges.

FIGS. *6a* and *6b* show the hydraulic trucking device 100 which includes a unit body 102 having an upright frame 104 and a hydraulic cylinder 106 on a horizontal guide platform 108. Body 102, including frame and platform, include rear wheels 112 and rollers 114. A glide plate 110 has a double "L" configuration and is positioned over platform 108 and jack 108. Glide plate 110 is provided at the end of the plate with an outer bar 120 which is wider than the glide plate. Glide plate 110 is also provided with an inner glide bar 122 on the inner vertical surface which bar is also wider than the glide plate 110 thereby defining a channel in which the glide plate may slide relative to upright frame 104. The glide plate moves up and down on frame 104 upon the actuation of the hydraulic cylinder.

Optionally, the lower portion of the glide plate 110 can be provided with a pair of rollers 105 on the outer edge of the plate as illustrated in FIG. *6c*. The rollers are substantially perpendicular to the axis of rotation of the wheels 112.

In FIG. *6a*, the glide plate is shown in the down position for sliding under the lower chord 14 or 15 of the flying frame. The jack is operated by jack handle 116 pivotally connected to frame 104 and pivotally connected through actuation arm 118 to the cylinder whereby glide plate 110 may be raised to an upright position or lowered to a down position as shown in FIG. *6b*.

FIGS. *7a* and *7b* illustrate roller assembly 200 in detail. The roller assembly 200 includes an outer rail 202 and an inner rail 204 spaced apart in substantially parallel arrangement and secured together by tie rod 206. A pair of rollers 208 are positioned on opposite sides of tie rod 206 with holding plates 210a and 210b positioned at opposite ends of the rollers at a predetermined distance. Rollers 208 are located to be higher than the holding plates 210a and 210b to allow chord 14 and 15 to roll over rollers 208 and against side roller 212.

As can be seen in FIG. *7b*, the holding plates and accompanying rollers are pivotal on tie rod 206 to allow for equalizing the load on the rollers 208 and for a smooth movement of the flying frame along the rollers even in situations where the rough floor of the structure itself may be uneven.

A pair of vertical rollers 212 having a substantially vertical axis of rotation assist in the travel of the frame on rollers 208. The roller assembly further includes a protector brace 214 for the vertical rollers which assists in aligning the roller unit 200 with the lower chord when the chord is above the roller unit 200. Brace 214 also acts as a handle for carrying the rollers and as a means for attaching a rope to insure that the rollers do not fall off the edge of the floor as the flying form is being flown.

FIGS. *8a*, *8b*, *8c* and *8d* illustrate the levered trucking device. The levered trucking device 300 has a "V" shaped body 302 with one side slightly longer than the other side. The shorter side has a ball 304 centrally located. On the longer side of the body, arm 306 extends therefrom. Arm 306 is illustrated as being joined to the body by means of a post 310 and a corresponding recess in the end of the arm. It can be appreciated that any method of joining the arm to the body would be suitable. At the end of the arm remote from the body 302 there is a handle 308. On each side of body 302, wheels 312 extend on axis 314 which extend from the body on each side thereof. Wheels 312 are retained on the axis 314 by conventional means such as a cotter pin or spring clip. Wheels 312 preferably have a diameter of approximately 1½ to 3½ inches, sufficient to raise a frame off a 2"×4" block.

The body 302 is angled and the length of arm 306 is configured such that when the handle 308 is at a height of approximately 3 feet, ball 304 will be at its highest point By slightly lowering the handle 308, stop 303 will contact the floor slab surface maintaining body 302 to rest in an upright position. This will maintain a chord in a raised position permitting the operator to release the handle in order to insert wedge blocks 30 as will be discussed below.

An alternative to using trucking device 100 as described above is a trucking device as illustrated in FIG. 8. The larger trucking device is shown generally as 400. Trucking device 400 has wheels 412 which have a diameter of the same order as the height differential between the form 10 and the desired height of the upper floor, approximately 3½ to 5½ inches. The trucking device 400 has a first arm 402 extending from body 403. Ball 404 extends from arm 403. Handle arm 406 extends from body 403 defining a "V".

The trucking device is configured such that the ball 404 may be inserted under lower chord 14 or 15 until the ball 404 is registered within recess 26. By pulling back on the handle 406, the trucking device will pivot about the ball 404 causing the device to lift the frame as it rolls thereunder.

Figure 8B:
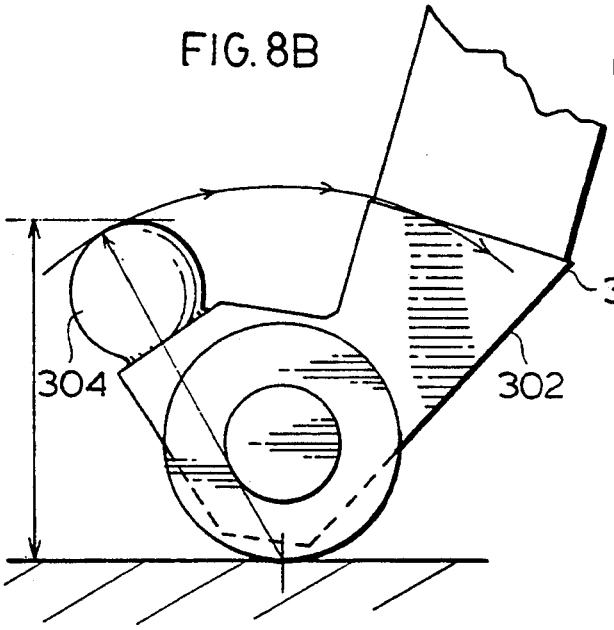
FIG. 8*a* is a perspective view of the lever trucking device of the present invention; and, FIG. 8*b* is a partial side elevational view illustrating the lever trucking device of FIG. 8*a;*
FIG. 8*c* is a partial side elevational view illustrating the lever trucking device of FIG. 8*a* in a maximum trucking position.
FIG. 8*d* is a partial side elevational view illustrating the lever trucking device of FIG. 8*a* in a resting position.
FIG. 8*e* is a second embodiment of the lever trucking device.
FIG. 8*f* is a top view of two lever trucking device of FIG. 8*e* is operation.
FIG. 8*g* is a partial oblique view of the lever trucking device of FIG. 8*e* in operation.
Figure 8A:
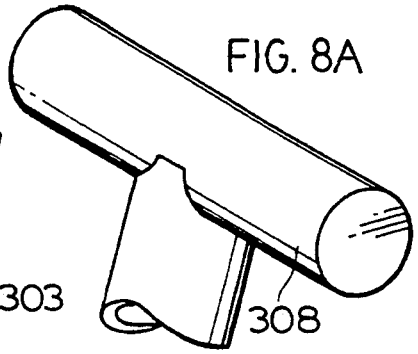
Figure 8A:
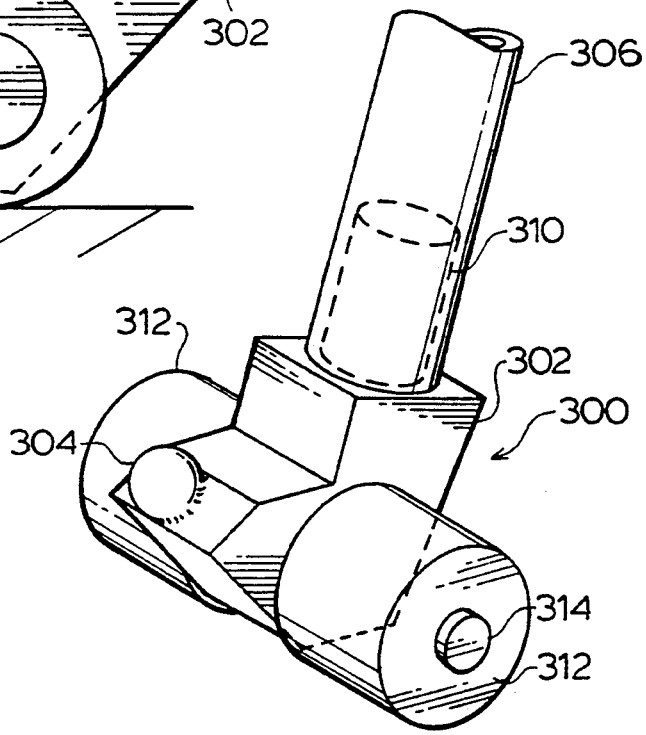
Figure 8C:
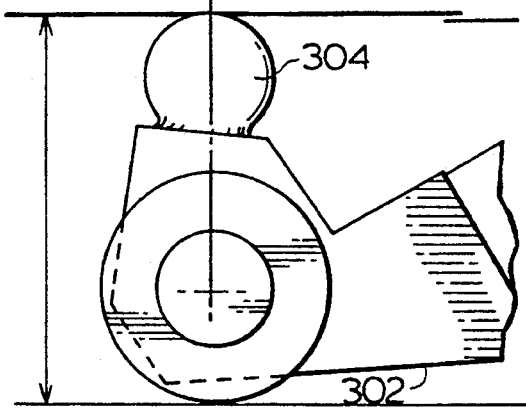
Figure 8D:
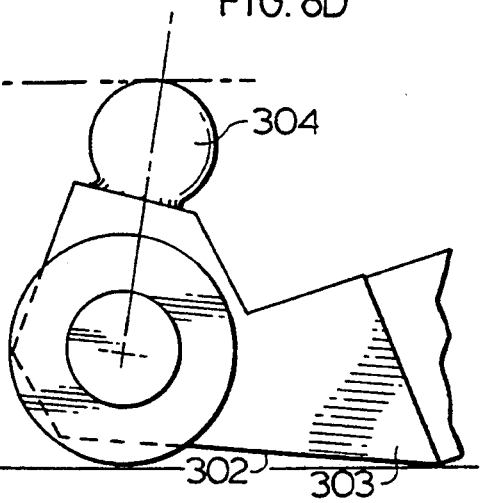
Figure 8E:
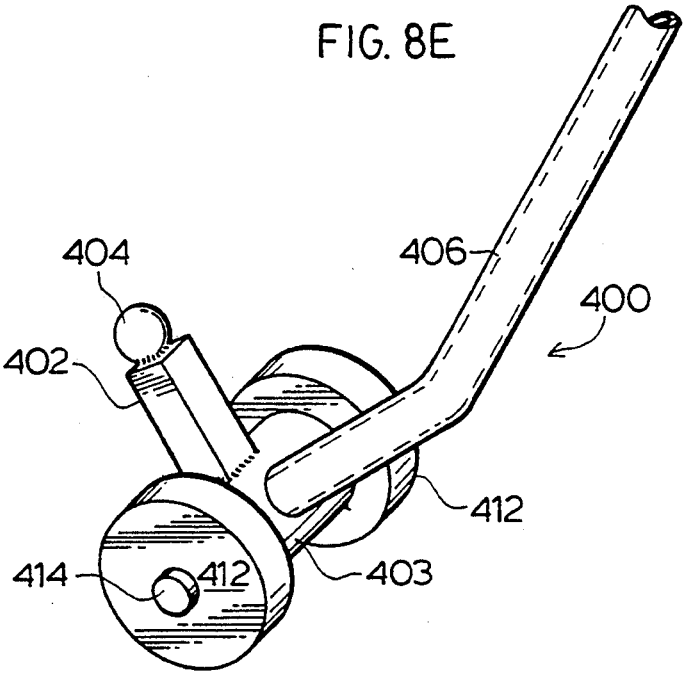
Figure 8F:
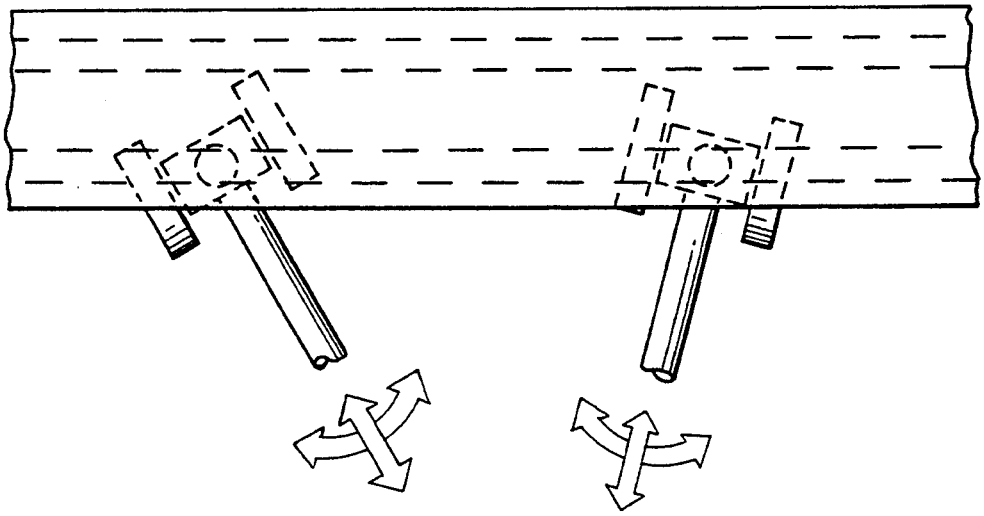
Figure 8G:
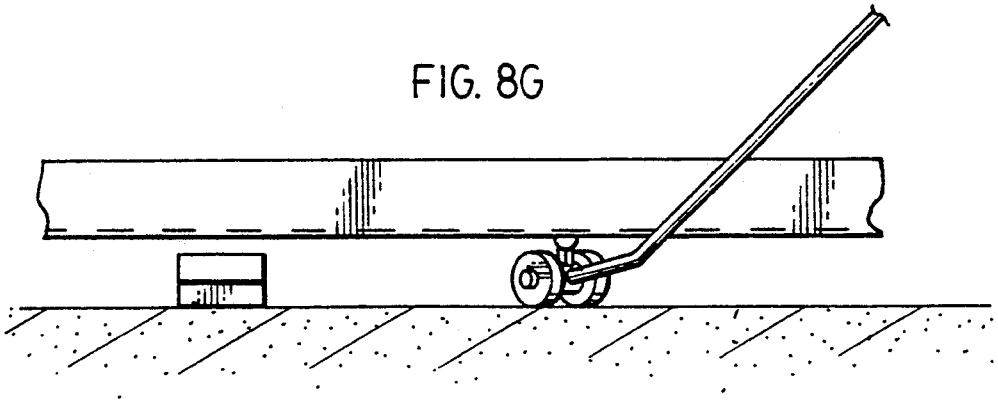
Figure 9:
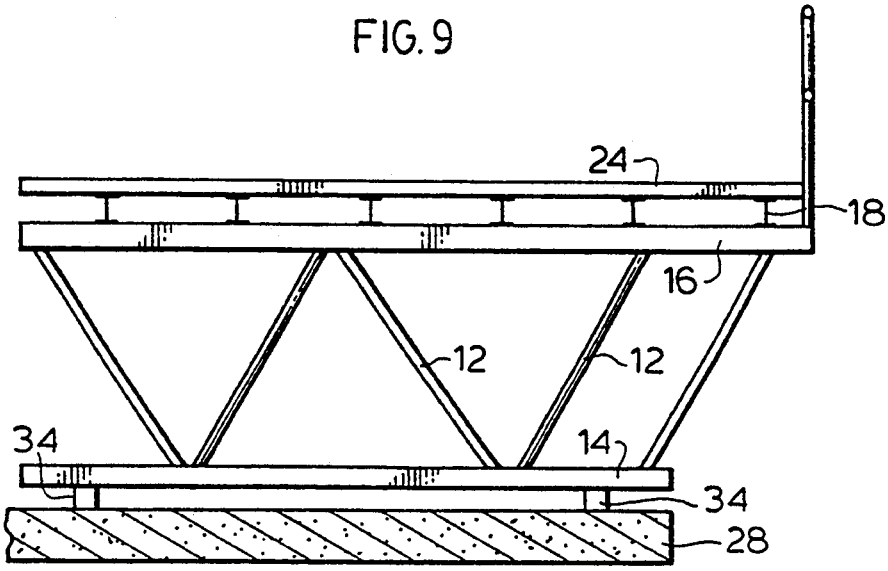
FIG. 9 is a side partial view of a flying frame of the embodiment of FIG. 2 in a rest position.
Figure 10:
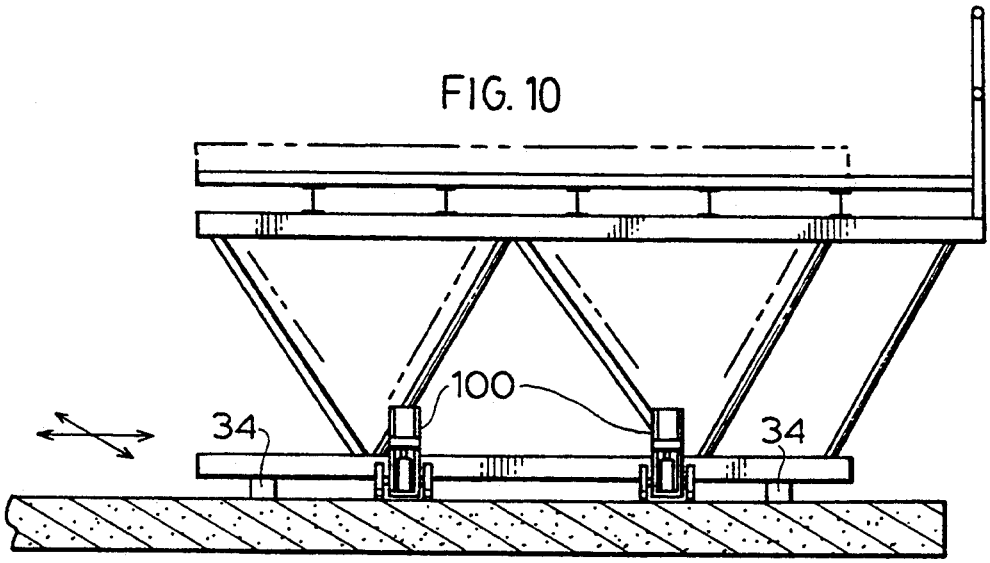
FIG. 10 is a side partial view of the flying frame of the embodiment of FIG. 2 in a height adjustment position.

As illustrated in FIG. 8*g* the height of the ball 404 when in a maximum lifting position must be greater than the maximum height of the wedge blocks 30. The trucking device permit the frame to be moved to the desired position and will lift the frame to permit the blocks 30 to be inserted under the frame to achieve the desired height of the frame.

Figure 6B:
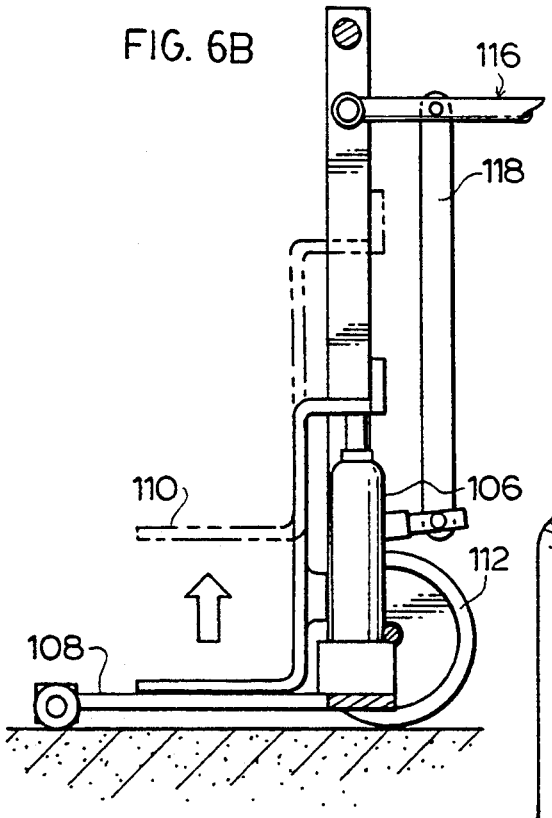
FIG. 6*b* is a side view of the hydraulic trucking device of FIG. 6*a;*
Figure 6A:
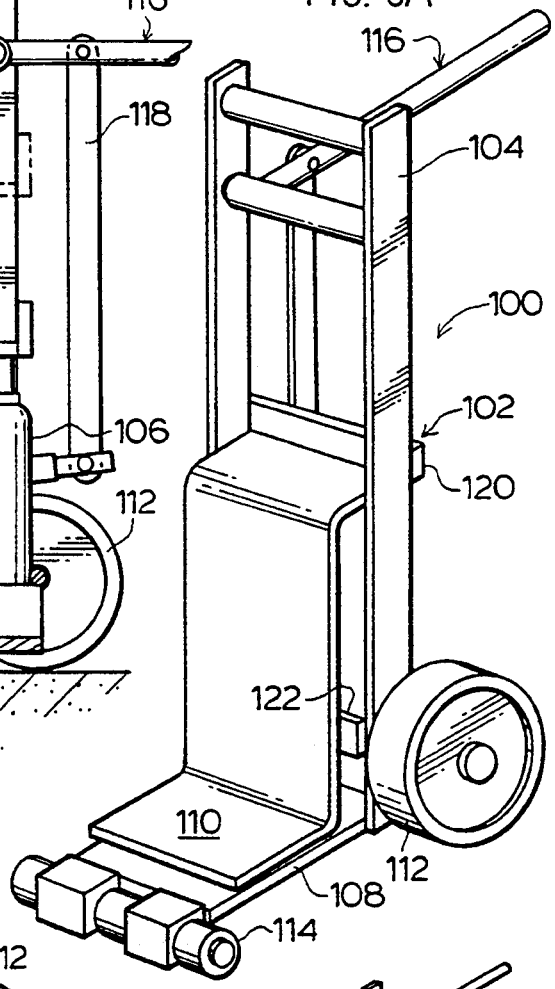
FIG. 6*a* is a perspective view of hydraulic trucking device of the present invention.
Figure 7A:
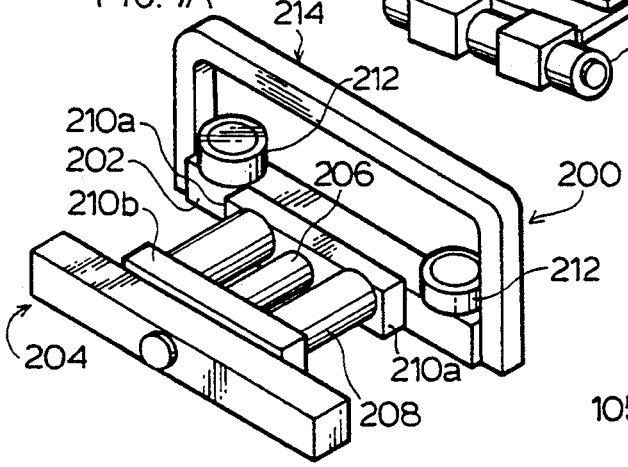
FIG. 7*a* is a perspective view of the roller assembly of the present invention.
Figure 6C:
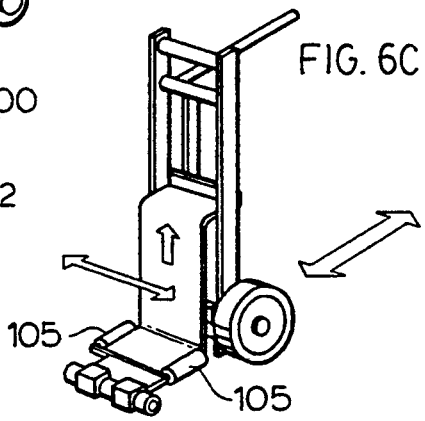
FIG. 6*c* is a perspective view of a second embodiment of the hydraulic trucking device of the present invention.
Figure 7B:
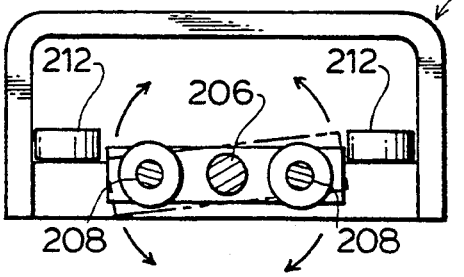
FIG. 7*b* is a front elevational view of partial illustration of roller assembly illustrated in FIG. 7*a;*

As illustrated in FIG. 8*f*, the trucking devices 300 or 400 has an advantage over the hydraulic trucking device 100 illustrated in FIG. 6 in that the hydraulic device 100 has only two degrees of freedom in maneuvering the form about the floor. Trucking devices 300 or 400 can rotate about the ball in any direction and therefore by concerting the trucking devices the form can be maneuvered to any location.

In use, trucking devices 300 or 400 requires at least two workers but preferably four workers to operate the trucking devices in concert. In comparison, a single worker may manipulate the flying frame using hydraulic trucking devices 100.

Preferably, the frame is manufactured from aluminum to reduce the weight of the frame. Similarly, wedge blocks 30 may also be made of aluminum. Since the hydraulic trucking device 100, the levered trucking devices 300 and 400 and the rollers 200 must be strong enough to lift the weight of the frame, these devices are preferable made from carbon steel.

The operation of the flying form with the various components discussed will now be described in detail.

For construction site, the flying forms can be delivered to the site in a dismantled or partially assembled form. The length of the desired form for a particular job will be known and will depend upon the specifications of the building to be constructed. The height between floors will also be specified and are usually uniform for the substantial part of the building. Having this information the forms may be assembled at the job site or partially pre-assembled and finally assembled at the job site. For lengths greater than the standard lengths available, forms may be spliced together to achieve the desired lengths.

The height of the assembled form is to be slightly less than the specified height between floors of the building. The total height of the form is the sum of the thickness of the deck 24, the height of the support beam 18 and the combined height of the frame. The preferred height difference between the height of the form and the height between floors can range between 3½ and 5½ inches. A chart can be prepared designating the combination of preferred holes for the struts 12, the upper chord and the H bracket to achieve the preferred height. The chart will take into account the height of the wedge blocks 30.

FIGS. 9 to 17 illustrate the steps of positioning the flying frame on a floor or base to support poured concrete to form an upper flooring.

Once the flying form has been assembled to achieve the desired height of the frame, it is connected to the cables of the crane (not illustrated) in a conventional manner to upper chords 16 and 17. The form is carried and deposited to the desired location on the floor 28 where fly forming is to commence. Since crane time is expensive, the form is deposited on wood blocks 34 not necessarily in the exact desired location permitting the flying form to rest slightly above the surface of floor 28. Once resting on the blocks, the flying form may be removed from the crane cables.

If more forms are required, they can be deposited near the first form in a like manner.

Blocks 34 must be of a sufficient height to permit the leading edge of hydraulic trucking device 100 to be inserted underneath the flying form 10, in particular, under lower chords 14 and 15. Standard 4"×4" lumber which is readily available on any job site has been found to be ideal for this purpose.

The leading edge of the hydraulic trucking device 100 of FIG. 6*a* is inserted underneath the lower chord 14 or 15 such that glide plate 110 is immediately below lower chord 14 or 15. To move the flying form efficiently, at least four hydraulic trucking devices will be required near each corner in order to move the flying form.

Four of such hydraulic trucking devices 100 are installed at the four corners of the flying form. The jack is raised by pumping handle 116 raising glide plate 110 until the flying form 10 rests upon rollers 105 and is off the blocks 34. Once the flying form has been raised, blocks 34 may be removed from under the flying form and out of the way The flying form may now be rolled longitudinally and transversely to the desired location. Preferably, upper deck 24 will abut or align with one of the walls or with a row of columns from which the poured concrete floor is to span.

Once at the desired location, the hydraulic jacks can be used to raise or lower the flying form to the desired height with requisite precision. Once the desired height has been achieved, wedge blocks 30 are inserted under the lower chord 14 or 15 at the "V" shape formed by adjacent struts 12 of the frame until handle 42 abuts with lower chord 14 and 15. The wedge blocks preferable are placed directly under all of the "V" of the flying form. Handles 46 are advanced raising upper wedge 38 until wedge blocks 30 fully support the frame.

Once the wedge blocks fully support the flying form at the exact desired height, the hydraulic trucking devices may be removed for reuse. All levelling or adjusting is done while the hydraulic trucking device is under chords 14 and 15 to insure that the final desired height is achieved.

The process is repeated for the adjacent form such that the upper deck 24 of the adjacent form abuts with the upper deck of the first flying form or the space between forms is of a uniform shape. The spaces are covered with plywood sheets or the like. However, since the spaces should be uniform for each floor, the plywood sheets need only be cut once and may be reused for subsequent floors. A substantially uniform deck surface is presented from the first wall or row of columns to the second wall or row of columns from which the poured concrete floor is to span.

Figure 11:
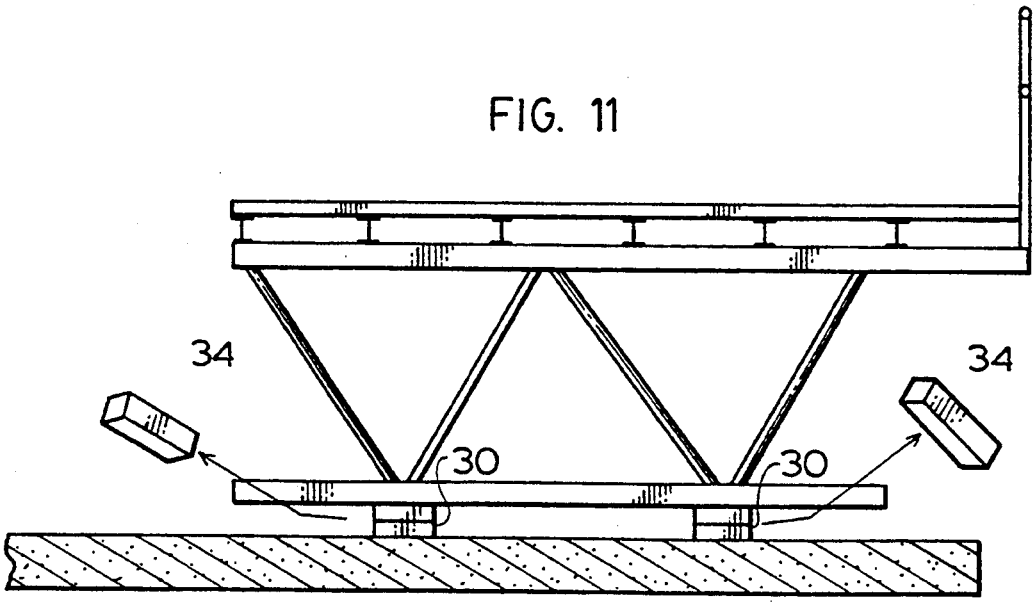
FIG. 11 is a side partial view of the flying frame of the embodiment of FIG. 2 in a fixed height position.

In FIG. 11, the form is positioned on floor 28 so that lower chord 14 and 15 rest on a series of adjustable wedged blocks 30.

Figure 12:
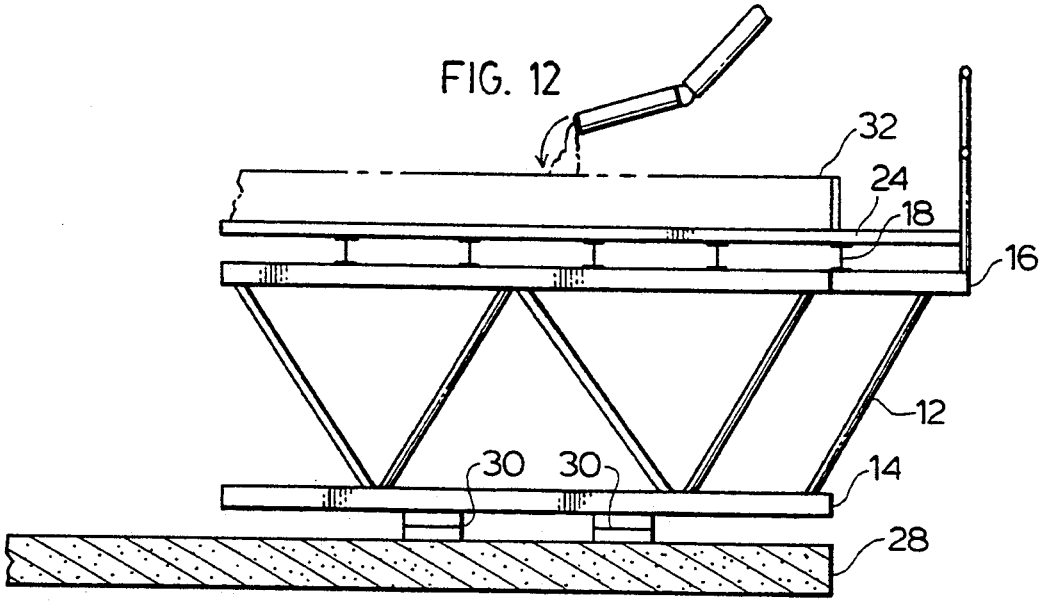
FIG. 12 is a side partial illustration of a flying frame of the embodiment of FIG. 2 in a position for receiving poured concrete.

As shown in FIG. 12, the wedged blocks 30 are placed under lower chord 14 and 15 to finely raise or lower the flying frame above the base or floor of the structure and hold upper deck 24 to the level of the floor to be constructed above. Should the deck 24 of the structure not be completely level, small adjustments can be made in the raising and levelling of the frame by manually operating handle 46 on the threaded shaft 44 that engages the wedges. Alternatively, the hydraulic trucking devices can be reinstalled to raise or lower the form to the desired height. With the frame so adjusted and other frames installed, concrete can be poured onto upper deck 24 as shown in FIG. 12.

Figure 13:
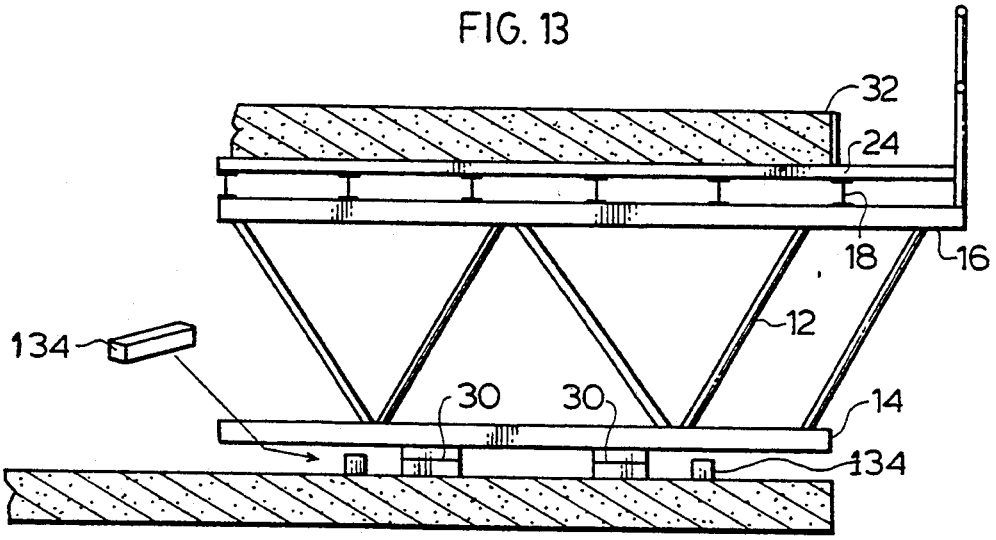
FIG. 13 is a side partial illustration of the frame of the embodiment of FIG. 2 ready to be "pulled down" from the set concrete.
Figure 14:
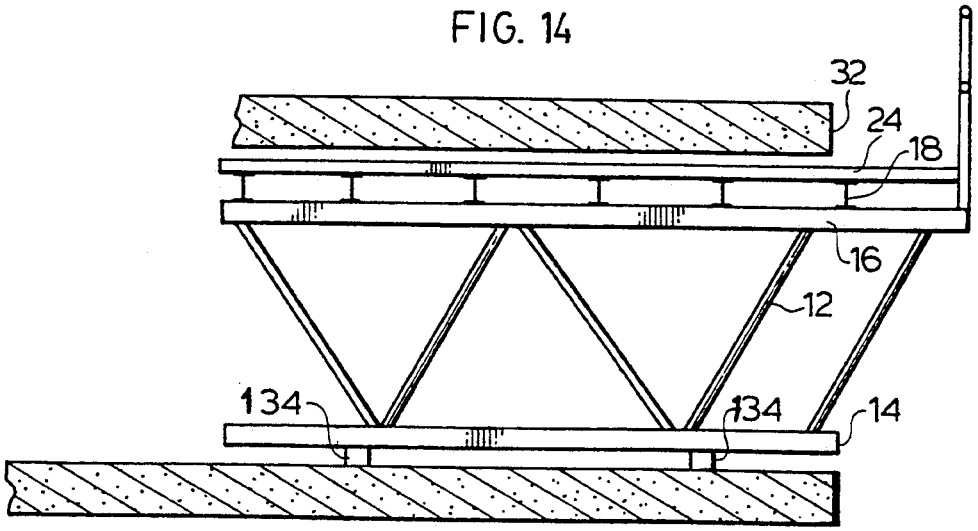
FIG. 14 is a side partial illustration of the frame of the embodiment of FIG. 2 separated from the set concrete.

When the poured concrete has partially cured and hardened into upper floor 32, as shown in FIG. 13, the wooden blocks 134 are positioned under lower chord 14 and 15. Standard 2"×4" lumber which is readily available on any job site has been found to be ideal for this purpose. Handle 46 of blocks 30 may be unscrewed thereby lowering the upper wedge 38. If the frame sticks to the upper floor 32, which is usual, the wedged blocks can now be removed and the frame encouraged to fall onto blocks 134.

Figure 15:
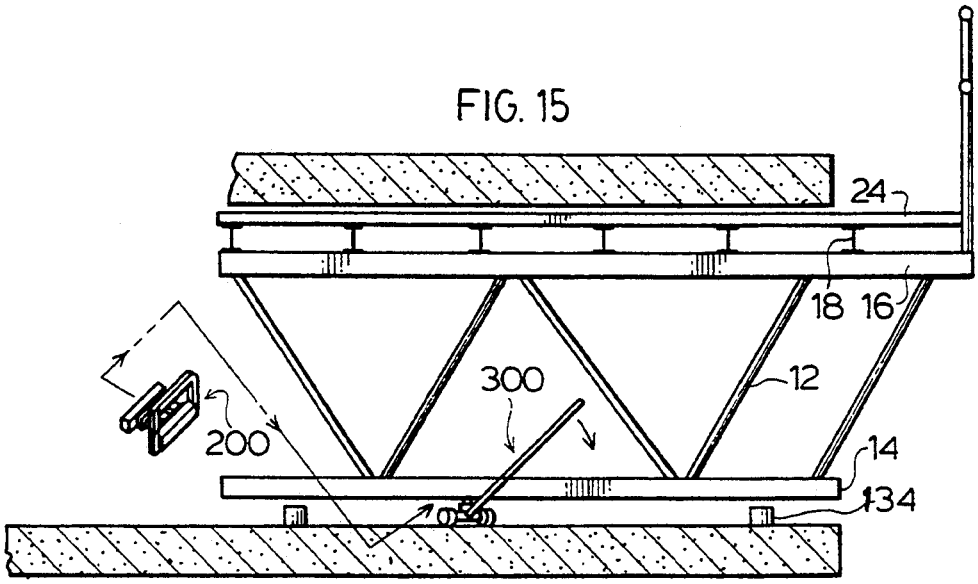
FIG. 15 is side partial illustration of the engagement of the frame of the embodiment of FIG. 2 by a lever trucking device.
Figure 16:
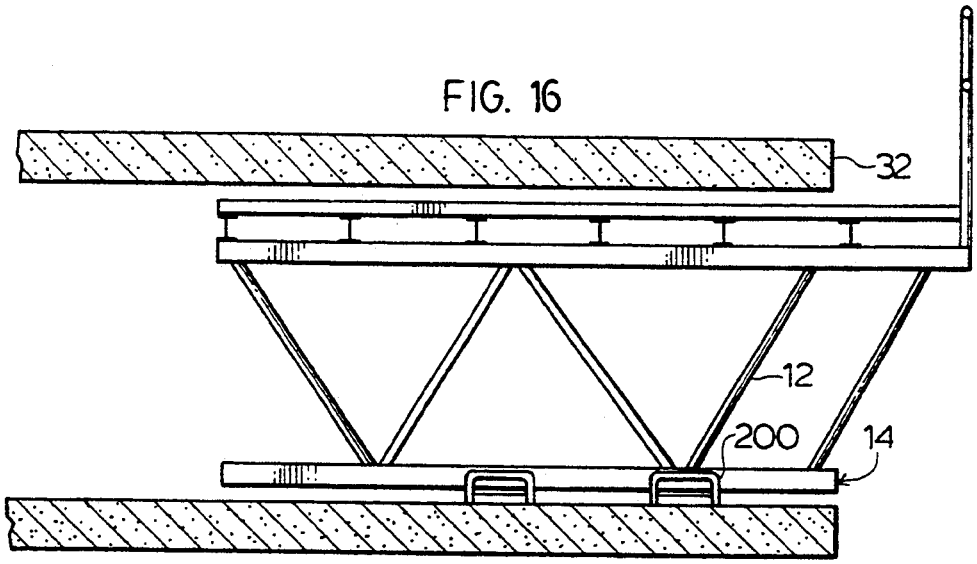
FIG. 16 is a side partial illustration of the frame of the embodiment of FIG. 2 mounted on roller assemblies.
Figure 17:
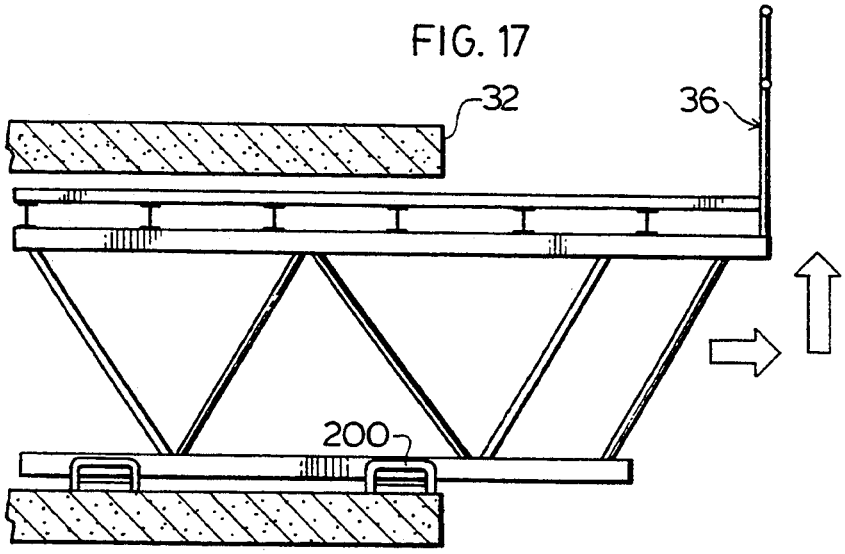
FIG. 17 is a partial side illustration of the frame of the embodiment of FIG. 2 being moved laterally through an opening for flying to the next floor.

FIGS. 15, 16 and 17 illustrate a means for removing the flying frame from blocks 134 so that it can be subsequently gripped by a crane and lifted or "flown" to the newly structured second floor where the support method can be repeated to lay a further floor onto the structure.

FIG. 15 shows the step following the drop of the upper deck from the set concrete floor. In the illustration, a levered trucking device 300 is inserted under the frame. Ball 304 is placed under lower chord 14 or 15 until the ball 304 rests within recess 26 on the under surface of lower chord 14 or 15. By pulling back on handle 308, the frame is raised by the lever action of the trucking device 300 from blocks 134. The frame may now be rolled to a location which is more suitable for flying as is sometimes required to remove the frame from between columns so that the frame can be rolled straight out.

Two or more roller assemblies 200 are positioned under lower chord 14 and 15 and the wooden blocks 134 are removed. Preferably one pair of rollers 200 are placed under chords 14 and 15 at the edge of the concrete floor and one pair slightly more than half of the length of the chords from the edge.

Levered trucking device 300 is disengaged and the flying frame sits on the roller assemblies 200 as shown in FIG. 16. The flying frame is then rolled longitudinally on the aligned roller assemblies 200 through an end wall left open on the structure.

The frame is thereby moved outwardly in the direction of the arrow shown in FIG. 17 approximately ⅓ of the length of the frame and connected to crane cables 36 in a manner well known in the art. The frame is moved outwardly a further ⅓ of its length being supported by the first set of cables 36 and rollers 200. A second set of cables are then attached to the frame. The frame is drawn out of the structure and subsequently lifted onto the new upper floor produced by the hardened concrete layer 32, where an additional floor can be laid after side walls or columns have been erected.

In the lifting of the frame as described above, it is preferable that at least two such lever trucking devices be used, but generally two sets of four such devices would be used on an average construction job, i.e. fours larger trucking devices and four smaller trucking devices. The four larger trucking devices can replace the hydraulic trucking devices 100 or the hydraulic trucking devices could replace the two sets of lever trucking devices.

Alternatively, when the flying frame is to be removed from the structure after setting of the upper concrete floor, hydraulic trucking device 100 can be rolled under lower chord 14 and 15 so that glide plate 110 can be located under the chord. When two or more such trucking devices are positioned along the frame, the hydraulic jacking system of each device is actuated so that their respective platform rises and engages the lower chord 14 and 15. As many of such devices are used as is required to lift the frame to place the rollers 200 beneath chords 14 and 15. In most cases two trucking devices 100 will be adequate.

A number of roller assemblies 200 are positioned along and under the frame. With the wooden blocks removed, the trucking devices are disengaged and removed so that the frame rests on the series of roller assemblies 200. The frame can then be manually moved longitudinally along the rollers to an open wall in the structure until its weight is taken up by the crane cable as described with reference to FIG. 17.

The frame is flown to the upper floor 32 and the process is repeated.

Although the disclosure describes and illustrates preferred embodiments of the invention, it is to be understood that the invention is not limited to these particular embodiments. Many variations and modifications will now occur to those skilled in the art. For a definition of the invention, reference is to be made to the appended claims.

I claim:

1. A concrete forming apparatus for use in construction of buildings having poured concrete floors spanning between two adjacent supports at a desired height, comprising a) a frame having first and second trusses, each having longitudinally extending upper and lower chords and extensible strut members extending diagonally therebetween capable of temporarily fixing the distance between the upper and lower chords, said upper and lower chords having a series of spaced attachment means for securing said struts to said chords at a plurality of locations, spacing means for releasably connecting the first and second trusses in a spaced substantially parallel relation, transverse joist members releasably connected to the upper chord of the truss, a substantially planar upper deck releasably joined to the joist members providing a lower form surface of a concrete floor to be poured, said frame being adjustable to a height of an order of but less than the desired height, and b) support means for supporting and maneuvering the frame, comprising a plurality of trucking devices adapted to engage the lower chord of the frame for raising the frame between a rest position whereby the frame is spaced above a floor surface and a pouring position whereby the upper deck is substantially at the desired height, and for rolling the frame to a desired location, said trucking devices adapted to roll over the floor surface; said trucking devices comprise a base comprising a vertical element and a horizontal element, a first roller means mounted on the horizontal element of said base for rolling said device along the floor in a first direction, a platform slidingly engaging the vertical element of said base and adapted for vertical movement relative to the base and a jack connected between the frame and the platform for effecting said movement; and a second roller means is mounted on said platform adapted for receiving the lower chord and rolling the frame in a second direction substantially perpendicular to said first direction:

a plurality of support devices adapted to rest on the floor surface for supporting the frame while in the pouring position during the pouring and curing of the concrete floor, said devices having means for finely adjusting the height of the frame:

a plurality of roller assemblies adapted rest on the floor surface to receive the lower chords of the frame for rolling the frame along as the frame is flown from under the concrete floor up onto the concrete floor.

2. An apparatus as claimed in claim 1 wherein the jack is hydraulic.

3. An apparatus as claimed in claim 2 wherein the extensible strut members comprise an outer member adapted to receive an inner member in sliding fit and having locking means for releasably locking said inner and outer member in a plurality of fixed positions.

4. An apparatus as claimed in claim 3 wherein the locking means comprises a plurality of horizontally extending holes in a spaced relation in the outer member and complimentary holes in the inner member and spaced from one end thereof, a first peg for inserting into one of the holes of the outer member to align the complimentary holes, a second peg for inserting through a hole in the outer and inner member above the first peg, said one end of the inner member having an indentation for abutting the first peg upon insertion of the inner member within the outer member and aligning the complementary holes.

5. An apparatus as claimed in claim 4 wherein said first and second peg are integral with each other and the first peg is longer than the second peg.

6. An apparatus as claimed in claim 1 wherein the spacing means comprises a plurality of cross braces releasably connected between the trusses.

7. An apparatus as claimed in claim 6 wherein the lower chord is provided with a longitudinally extending channel on the upper surface thereof adapted for receiving the head of a T-bolt for joining the cross braces to the lower chord.

8. An apparatus as claimed in claim 7 wherein the extensible strut members are provided with releasable connection means for connecting the cross braces to the truss members.

9. An apparatus as claimed in claim 1 wherein said apparatus further comprises a plurality of second trucking devices, said second trucking devices comprise a body having ground engaging wheels rotatably mounted thereon, a pivot mounted on said body, and a handle extending from the body whereby upon urging the handle in a downwardly direction the pivot contacts the underside of the lower chord and the frame is raised as the wheels becomes fully registered beneath the frame.

10. An apparatus as claimed in claim 1 wherein said support device comprises a first wedge having a bottom surface and an inclined surface, a second wedge having a top surface and an inclined surface presented to the inclined surface of the first wedge, the top surface substantially parallel to the bottom surface, and means for advancing the wedges together raising the top surface relative to the bottom surface.

11. An apparatus as claimed in claim 9 wherein said wheels of the first trucking device is adapted to raise the frame between $3\frac{1}{2}$ and $5\frac{1}{2}$ inches and said second trucking device is adapted to raise the frame between $1\frac{1}{2}$ to $3\frac{1}{2}$ inches.

* * * * *